US006644294B2

(12) United States Patent
Christensen

(10) Patent No.: US 6,644,294 B2
(45) Date of Patent: Nov. 11, 2003

(54) AIR CANNON

(76) Inventor: Robert N. Christensen, 1300 A1A S. Oceancrest #502, Jupiter, FL (US) 33477

( * ) Notice: Subject to any disclaimer, the term of this patent is extended or adjusted under 35 U.S.C. 154(b) by 0 days.

(21) Appl. No.: 10/035,480

(22) Filed: Nov. 9, 2001

(65) Prior Publication Data

US 2003/0089361 A1 May 15, 2003

(51) Int. Cl.[7] ..... F41B 11/00
(52) U.S. Cl. ..... 124/77; 124/32
(58) Field of Search ..... 124/63–77; 42/113, 42/114

(56) References Cited

U.S. PATENT DOCUMENTS

| | | | | | |
|---|---|---|---|---|---|
| 3,469,842 | A | | 9/1969 | Welbourn | |
| 3,582,079 | A | | 6/1971 | Breslow | |
| 3,807,379 | A | * | 4/1974 | Vodinh | 124/26 |
| 3,843,125 | A | | 10/1974 | Loose et al. | |
| 3,938,272 | A | | 2/1976 | Ditto et al. | |
| 4,021,037 | A | | 5/1977 | Torbet | |
| 4,086,902 | A | | 5/1978 | Reynolds | |
| 4,094,292 | A | | 6/1978 | Speer | |
| 4,183,530 | A | | 1/1980 | Roop | |
| 4,223,472 | A | | 9/1980 | Fekete et al. | |
| 4,703,869 | A | | 11/1987 | Rooy | |
| 4,770,153 | A | * | 9/1988 | Edelman | 124/72 |
| 5,343,849 | A | | 9/1994 | Steer | |
| 5,599,187 | A | * | 2/1997 | Mesiano | 434/19 |
| 5,613,678 | A | | 3/1997 | McKee et al. | |
| 5,681,043 | A | | 10/1997 | Winblad et al. | |
| 5,727,538 | A | * | 3/1998 | Ellis | 124/77 |
| 5,769,066 | A | | 6/1998 | Schneider | |
| 5,850,826 | A | | 12/1998 | Guthrie | |
| 5,857,451 | A | * | 1/1999 | Ciluffo et al. | 124/6 |
| 5,890,479 | A | * | 4/1999 | Morin | 124/31 |
| 6,026,798 | A | * | 2/2000 | Sanders et al. | 124/78 |
| 6,035,843 | A | | 3/2000 | Smith et al. | |
| 6,065,460 | A | | 5/2000 | Lotuaco | |
| 6,233,928 | B1 | | 5/2001 | Scott | |
| 6,276,353 | B1 | * | 8/2001 | Briggs et al. | 124/71 |
| 6,279,259 | B1 | * | 8/2001 | Otteman | 42/122 |
| 6,295,754 | B1 | * | 10/2001 | Otteman et al. | 42/124 |
| 6,349,711 | B1 | * | 2/2002 | Perry et al. | 124/73 |
| 6,481,429 | B2 | * | 11/2002 | Nishio et al. | 124/29 |
| 2002/0170551 | A1 | * | 11/2002 | Kotsiopoulos et al. | 124/54 |

* cited by examiner

*Primary Examiner*—Michael J. Carone
*Assistant Examiner*—Susan L Piascik
(74) *Attorney, Agent, or Firm*—McHale & Slavin, P.A.

(57) ABSTRACT

A golf ball projecting air cannon capable of propelling a golf ball or similar projectile with high pressure to reach distances beyond 100 yards. The device employs an electronic circuit providing safety, firing, and reloading controls. The timer and motor provide for the timed activation of a series of microswitches and solenoids to distribute air to various ports at a designated position within the device to force appropriate movements.

12 Claims, 4 Drawing Sheets

AIR CANNON

FIELD OF THE INVENTION

The present invention relates to recreational projectile launching devices, and more particularly to an improved air cannon for launching large projectiles such as golf balls, paint balls, and the like.

BACKGROUND OF THE INVENTION

Recreational projecting/launching devices are well-known in the art. Depending upon the target of interest, the projectile may be hollow or solid and launched at various velocities. Such devices typically include mechanisms for storing projectiles, automatically feeding the projectiles, and for launching the projectiles at various predetermined rates. The devices used for launching larger projectiles are typically actuated by pressurized gas or the like or include a means for developing such pressure for the purpose of launching.

Such devices are used for various entertainment purposes including tennis, golf, baseball, paint balls, or the like large projectiles. Such projectiles provide a safe and reusable supply of projectiles for use in numerous games such as war games. The various known patents all provide variations to launching devices typically for amusement purposes.

For instance, U.S. Pat. No. 5,769,066 discloses a gas powered ball gun for propelling ball projectiles, such as paint balls, found in amusement park settings. An air reservoir formed in a housing stores a pressurized gas charge which combines with gas pressure from a separate source to propel the ball projectile. Automatic reloading is accomplished by drop-feeding balls into the chamber from a vertical feeding tube.

U.S. Pat. No. 3,938,272 discloses a toy cannon which utilizes a flint ignition system igniting a fuel-air mixture to discharge a ball out of the barrel.

U.S. Pat. No. 4,223,472 discloses a toy projectile launching device which has a main tubular member in communication with an air pump, an air storage tank, and a projectile launching housing rotatably coupled to the main tubular member. The device launches a toy rocket from the launching housing. A manually operated valve is switchable between a first, second, and third position. The first position permits the transfer of air from an air pump to the air storage tank, the second position permits the passage of the compressed air from the air storage tank to the rocket launching housing, and the third position permits the escape of minute quantities of air through an air-operated sounding mechanism, such as a whistle.

U.S. Pat. No. 5,850,826 is drawn to a blow gun assembly for launching spherical projectiles, specifically paint balls. The device includes a loading chamber slidably received in a housing having loading, muzzle, and air input apertures. An ammunition clip in the form of a horizontal cylinder is provided. The loading chamber is movable from a first position to a second position within the housing, but is biased in the first position. When the loading chamber is in its second position, the breech channel is aligned with the loading aperture to define a projectile loading pathway, and a projectile will move from the ammunition clip into the breech channel of the loading chamber. When the loading chamber is in the first position, the breech channel is aligned with the muzzle aperture and the air input aperture to define a projectile launching pathway. A projectile will then move propelled through the breech channel into the barrel and is then discharged.

U.S. Pat. No. 4,086,902 discloses a toy projectile launching apparatus. The apparatus is pneumatically connected to an operating mechanism having a chamber whose size can be suddenly changed by squeezing, or a manual blow, or the release of a stressed spring, to alter the pneumatic pressure applied. The projectiles, which simulate shells or bullets, are fed into a launching position at the bottom of the magazine by gravity.

U.S. Pat. No. 5,343,849 discloses a rapid fire ball gun. A hollow body supports a pressurizable air vessel. A cylindrical ball chamber may hold a plurality of compressible foam balls between intermediate seals. Pulling the trigger of the gun releases pressurized air to expel a ball out the barrel.

U.S. Pat. No. 4,094,294 teaches a ball projecting device which utilizes a pneumatically operated detente in the barrel of the device. The detent holds the ball within the barrel until a predetermined air pressure is built up behind the ball, which then causes the detent to collapse, expelling the ball from the barrel.

Various games using toy projectiles are disclosed in U.S. Pat. Nos. 5,613,678, 5,681,043, 3,469,842, 3,582,079, 3,843,125, and 4,183,530.

While the foregoing described prior art devices have, in different ways, improved the state of the art for such ball launchers and toy guns, there remains a continuing demand for novel devices or improved gun features. In addition, the prior art fails to contemplate a controller means electrically coupled to a plurality of solenoids to provide a timing sequence for launching and relocating of another projectile.

SUMMARY OF THE INVENTION

The instant invention is an improved air cannon that electronically controls high pressure air to propel spherical projectiles, particularly golf balls or paint balls, for amusement purposes. The balls are propelled with sufficient pressure to allow targeting of objects at a distance of about 100–300 yards. When a firing means is actuated, a valve opens to send high pressure air behind a ball within the chamber, forcing the expulsion of that ball. The gun is then automatically restored to a firing position by way of activated microswitches and solenoids providing movement of components.

Following expulsion of a ball, a succession of microswitch-activated solenoids open designated air valves in a specific order for the controlled movement of components for reloading of the cannon. Once a ball is discharged, a retaining pin is slid to cover the main chamber opening, thereby preventing a next ball from entrance into the chamber as the breech, herein referred to as a retractable cylinder, is displaced. As this occurs, the retractable cylinder is moved backward. Next, the retaining pin is slid away from the entrance of the chamber, thus mobilizing a next ball located in a cylinder, constructed and arranged for housing a plurality of balls, to enter into the chamber. The retractable cylinder is then moved forward, pushing the ball forward within the main chamber in order to reach a firing position. Once reaching the proper position, plungers prohibit the ball from rolling forward; and, as a sensor detects the ball, an indicator light is illuminated, signaling the cannon is ready to fire again.

Accordingly, it is an objective of the instant invention to provide an electronically controlled air-powered cannon to launch projectiles in rapid succession with repeatable air pressures.

It is a further objective of the instant invention to provide an electronically controlled air-powered cannon to launch projectiles under high pressure to reach extended distances.

It is yet another objective of the instant invention to provide an electronically controlled air-powered cannon to launch projectiles which allows the end-user to visualize a projectile under low light conditions.

It is a still further objective of the invention to provide electronic based circuitry for the timed firing and reloading of projectiles.

It is a still further objective of the invention to provide a series of solenoids for an air-powered cannon controlled electronically for the precise movement of components.

It is yet another objective of the instant invention to provide an electronically controlled air-powered cannon to launch projectiles including safety features to inhibit firing.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

The present invention discloses a pressurized air cannon for projecting spherical golf ball sized objects and the like. The projectile launching apparatus having a main chamber and a feed chamber may house a supply of ball projectiles which are automatically fed into the main chamber in preparation for firing. A pneumatic projectile launching means fluidly coupled to the main chamber employs a plurality of solenoids for relocating, by low pressure, a projectile stored in the feed chamber into a launch position within the main chamber, thus making said projectile available for launching under high pressure. The pneumatic means may be from a remote source and is fed into various components of the body. Included is a controller means electrically coupled to the solenoids to provide a timing sequence for launching and relocating of another projectile which is preferably automatic.

Figure 1:
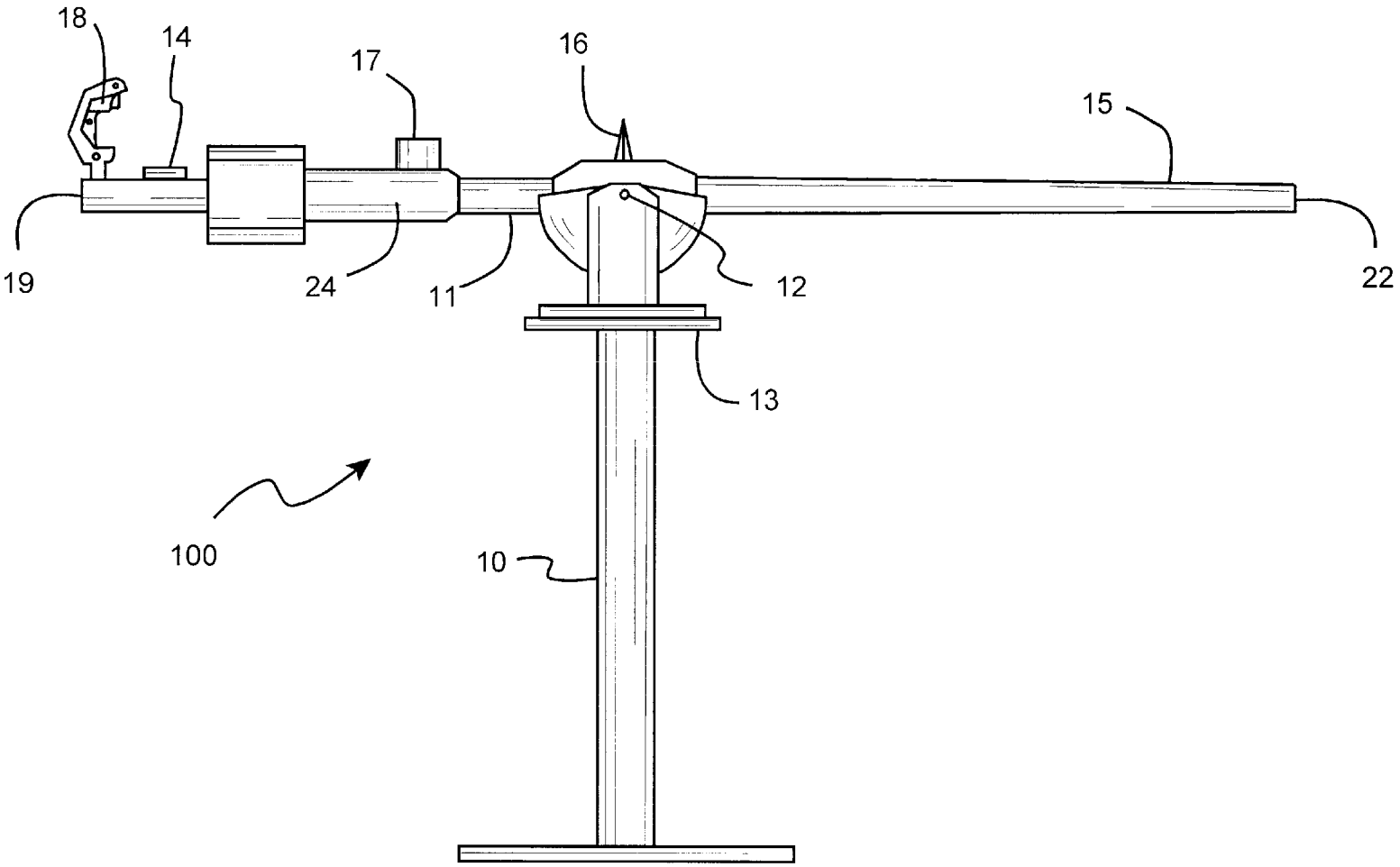
FIG. 1 is a pictorial view of the instant invention.

Referring now to FIG. 1, set forth is a side view of a preferred embodiment of the projectile launching apparatus 100. In this preferred embodiment, the projectile launching body, or cannon body 11, is securable to a base 10 having a rotatable and pivotable bracket 12 providing directional control which may be along a bearing plate 13. The cannon body 11 is then adjustable in direction, or azimuth, and elevation relative to the base 10. An angular gauge provides a sight locator positioned along a distal end of the main chamber to indicate the main chamber position along the barrel 15 of the body 11. An inclinometer 14 may be included which measures the degree of angle of the cannon and assists the user to pinpoint the anticipated trajectory of the projectile. The gauge measurement may be indicated in seconds, degrees, or the like indicia markings. A horizon sight gauge 16 may be included for aiming purposes. In order to provide safety of use, the bearing plate may include mechanical stops to control rotation when used in a confined area. At least one firing means positioned at a distal portion of the main chamber may include dual electronic triggers 18. A reservoir 17 is included for attaching a projectile feed channel. At least one indicator light 19 provides visual indication when the electronics system is operating so that the cannon is ready for deployment.

Figure 2:
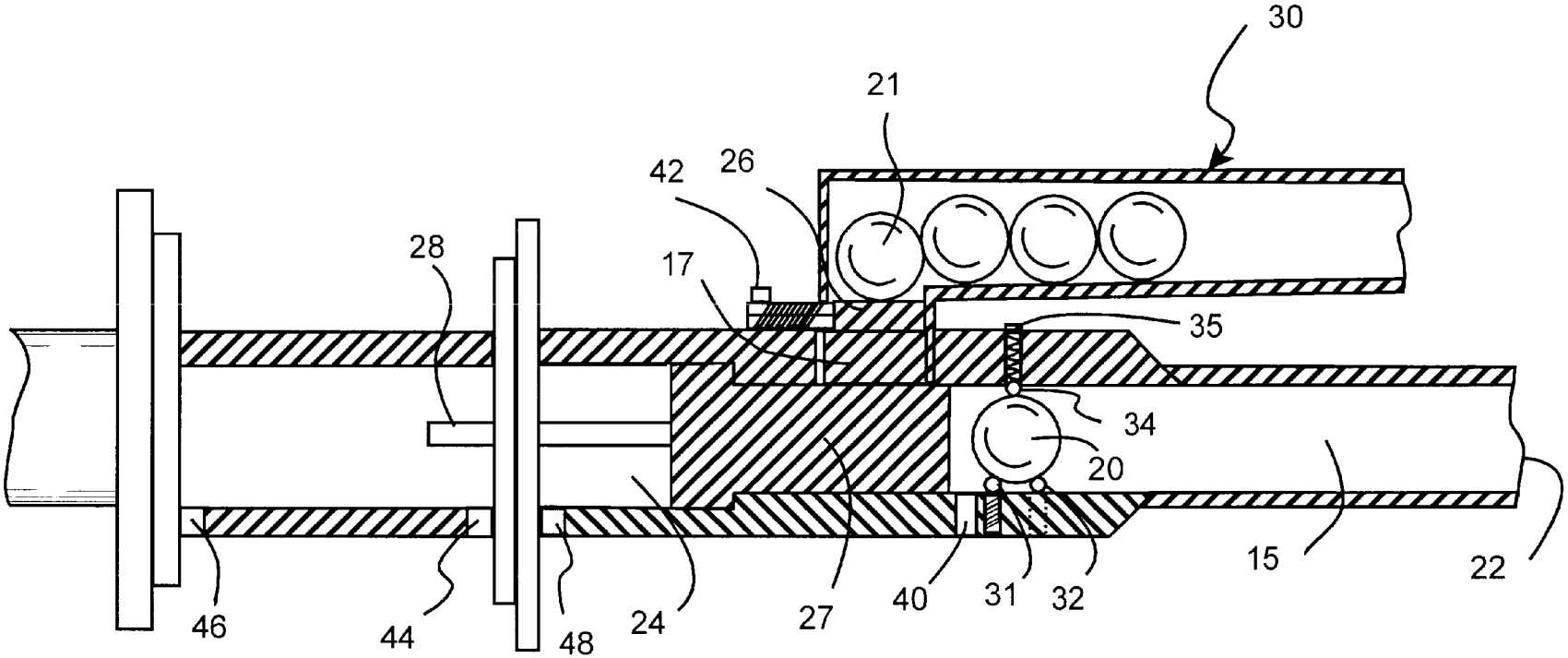
FIG. 2 is a sectional side view of the instant invention.

Referring to FIG. 2, a partial cross-sectional side view illustrates the main components of the body 11. When a trigger is actuated, the timing sequence for launching and relocating of another projectile is initiated. The following steps are illustrative for the use of a single cannon. A solenoid 114 is energized when a trigger is depressed which allows a high pressure air valve 40 to insert air for a period of 0.50 seconds. After the timing sequence counts 0.50 seconds, the projectile launches. The high pressure air valve 40 is preferably utilized solely for adequate propulsion means and is used to propel the projectile 20 from a forwardmost portion of the main chamber 24. The projectile 20 is then propelled out the end of the barrel 22. The barrel 15 lies forward the main chamber 24 and may be of any desired length.

Activation of a second solenoid 116 yields the opening of a low pressure air valve 42, for a period of approximately 0.35 seconds after the launching, to slide the retaining pin 26 into a closed position to the main chamber to inhibit a projectile 21 from entering the chamber. Activation of a third 120 and fourth 130 solenoid, for approximately 0.37 seconds following the sliding of the retaining pin, opens an air valve 44 to slide the breech block 27 and piston rod 28, which is interconnected with the breech block, backward away from the barrel 15. The main chamber 24, typically referred to as the breech, having at least two valves, houses the breech block 27 and the piston rod 28. The main chamber has at least two air ports for gas relief. The solenoids responsible for operating the piston 28 are located at the rear of the chamber. A fifth solenoid 132 causes a retaining pin 26 to slide into an open position to the main chamber after the sliding of the breech block, thus allowing a projectile 21 from the projectile feed channel 30, resting upon the retaining pin 26, to enter into the main chamber. The projectile feed channel or chamber 30 is a cylinder sufficient in size to allow a projectile to enter the main chamber and to house a plurality of similar sized projectiles. The retaining pin 26 is in slidable communication with the main chamber 24 and the projectile feed channel 30 and has at least one valve for automated movement. An equivalent period of time required for reaching a closed position, approximately 0.35 seconds, is required for reaching an open position.

During a period of approximately 0.40 seconds, by way of a sixth 122 and seventh 134 solenoid, an air valve 46 is opened at the rear of the chamber, and the interconnected piston and breech block, is slid forward, pushing the projectile 20 into a ready fire position after the sliding of the retaining pin into the open position. Although the components of the instant invention may utilize any type of suitable material appropriate for recreational launching devices, the retractable cylinder and piston are preferably composed of a solid metal material such as aluminum or steel. A means to inhibit a projectile from forward movement within the main chamber is also included. In a preferred embodiment, the launch position includes at least one plunger. Illustrated in FIG. 2, plungers 31, 32, 34 are spaced approximately 120 degrees apart, to position the projectile 20 within the main chamber. An associated microswitch 140 provides sensor control as a means for detecting the presence of a projectile. When a projectile 20 is in contact with the microswitch, a sensor 35 provides a means for indicating the presence of a projectile within the main chamber by illuminating an indicator 142 which also conveys operation of the circuitry and a ready fire position. The timed activation loop from the firing of a projectile to a ready fire position requires a period of approximately 1.97 seconds.

The means for providing a pressurized gas to the valves may be remotely located from the body of the apparatus or constructed and arranged to be housed within the body. The main valves are preferably located on the body in an area proximate to the circuit board. A compressor is preferably remotely located from the body of the apparatus at any preferred distance. The air pressure may be increased or decreased for the low or high pressure valves. For the high pressure valve, the pressure is preferably maintained at 175 psi, however, the pressure may be altered depending upon the velocity and distance desired for the propelled object. In addition, the means for providing pressurized air to the valves or the pneumatic projectile launching means may include a regulator for controlling a level of air pressure delivered to the valves. The low pressure delivered generally releases pressure of less than 80 psi; preferably maintained at 0–50 psi. The air valves connected to the body are preferably ¼ inch in diameter to the retaining pin and generally ⅜ inch for the rest, although the high pressure valve is preferably ½ inch in diameter. In a preferred embodiment, an exhaust valve 48 is included to expel condensation buildup during the movement of the breech block 27

A preferred embodiment of the instant invention relates to a cannon, or gun, having characteristics of an authentic anti-aircraft device. The firing means of the apparatus may include an illumination source such as a laser or a strobe, utilized as a targeting laser or strobe electrically coupled to a controller means. This would allow the user to visualize, in low light conditions, the path taken of the fired object. Additionally, moving targets such as model warships or the like, positioned at an extended distance may be included for aiming purposes or entertainment value.

Additional embodiments are contemplated for use in a variety of environments. The apparatus may be utilized at a driving range or at the stern of an appropriate watercraft for distance targeting and, therefore, the base may vary upon stability requirements. The apparatus may also be modified without a base as a hand-held version with a decreased firing pressure for more enclosed environments such as at an amusement center. Biodegradable balls or targets may be contemplated for any environment and various light-weight materials such as plastics (i.e. polyvinylchloride) would be contemplated for a hand-held version.

The means for controlled operation of the valves is maintained preferably through a precise timing mechanism electrically controlled by rotating discs within a circuit board designed to create a loop effect until the number of projectiles available expires, a safety feature is activated, or the power is terminated. Although placement of the electronics is not limited to any particular location either on the body of the apparatus or remotely, the location of the circuit board is preferably placed in an enclosed area near the rear end of the barrel. In a preferred embodiment, the controlled operation of the valves for the loop effect is accomplished by a plurality of activated solenoids on timers controlled by electronic switches, referred to as microswitches. Solenoids are arranged as intermediates between the timed activation of each microswitch to the opening and closing of each air valve. The solenoids used may be of any type of conventional means for converting electrical energy to mechanical energy for movement of the necessary components. A main switch may be utilized to provide instant power to both a printed circuit board and to the electric solenoids. In a preferred embodiment, an indicator light 110, such as a green light, would illuminate when the power is in use. In addition, any power source available for use with the present invention, such as an electrical outlet or a battery, is contemplated.

The circuit board may incorporate various safety features as a means to terminate the launching of a projectile. Also incorporated is the ability to simultaneously prohibit a plurality of linked cannons from firing. This may be accomplished, by way of example, electronically by terminating the power or by activating the retaining pin to maintain a closed position over the main chamber.

Figure 3A:
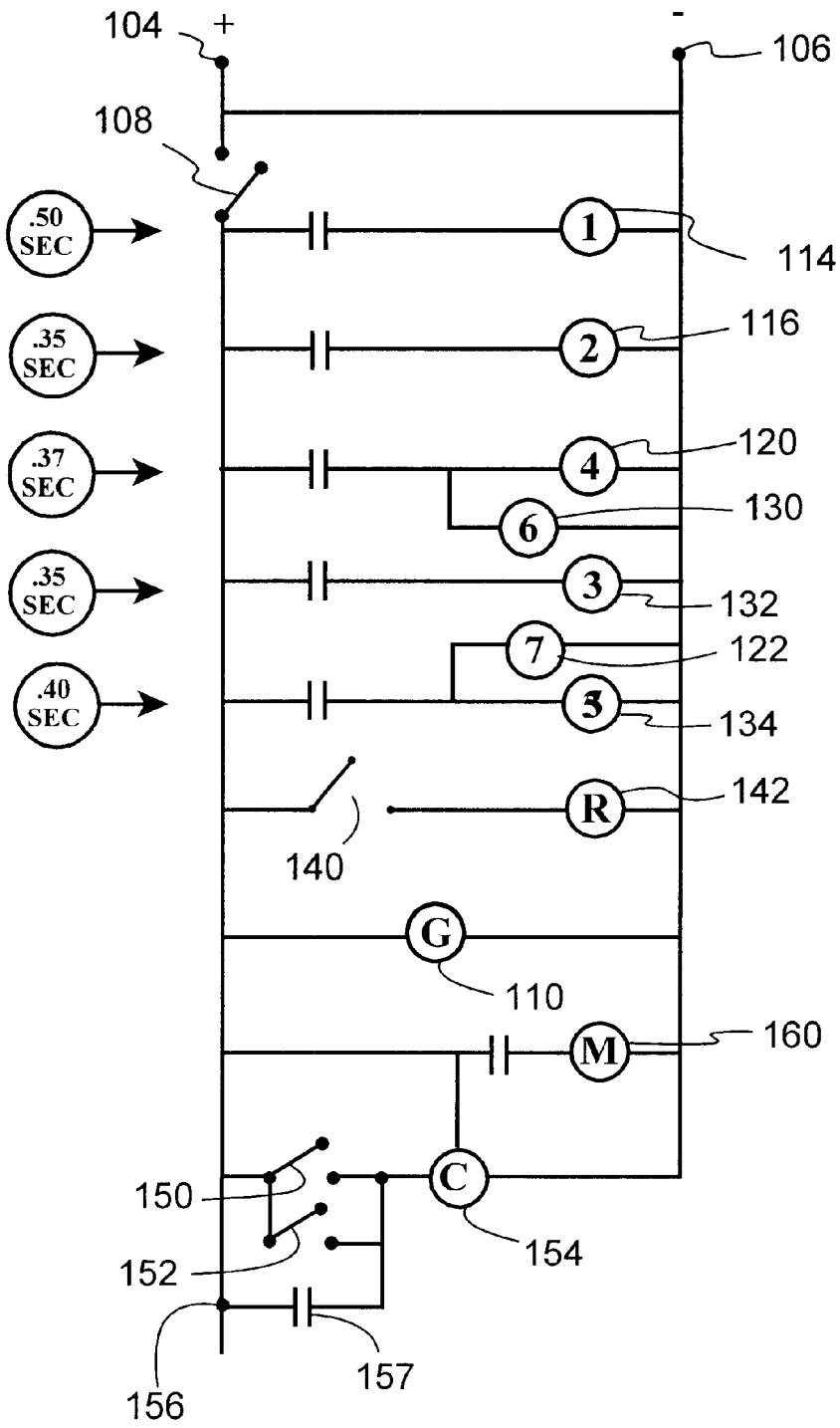
FIG. 3A is an electrical diagram of the preferred embodiment.
Figure 3B:
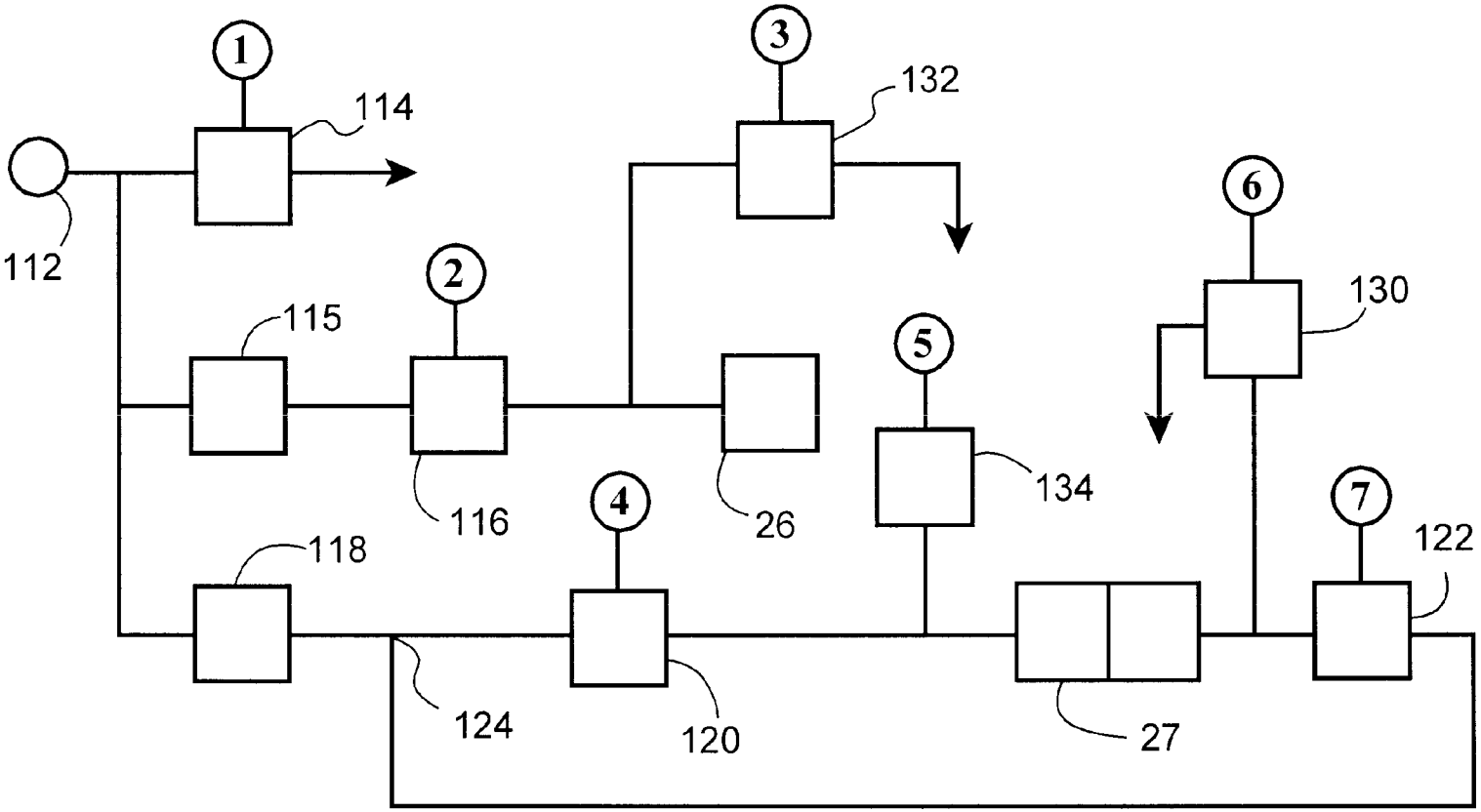
FIG. 3B is a flow diagram with cross reference to the electrical diagram of FIG. 3A.

Referring now to FIGS. 3A and 3B, set forth is an electrical flow schematic and a flow diagram. The preferred operating system is based upon 24 VDC power packs allowing for the reduction in line size to the various electrical components. The use of two power packs permits power delivery to the solenoids independent of the power directed to a printed circuit board containing all logic controls.

In operation, the circuit board 102 is electrically coupled to a positive side 104 and negative side 106 of a power pack wherein an operating switch 108 energizes the circuit as evident by illumination of the indicator light 110. The pressurized air 112, approximately 150 psi, is directed into a manifold to the inlet of the first solenoid valve 114, reduced in pressure to approximately 50 psi by regulator 115 to the second solenoid 116, reduced in pressure by regulator 118 to the fourth solenoid 120 and the seventh solenoid 122 through a connection tee 124. In the initial start-up mode, the device will be in a safety condition wherein the solenoid breech pin is energized in the "IN" position by operation of the second solenoid valve and the breech placed in the "OUT" position by energizing of the fourth solenoid 120 and the sixth solenoid 130. In this position the projectile will be stayed on the top of the breech opening with the projectile resting on the breech safety pin 26, thus prohibiting the projectile from entering into the breech.

As the power is turned on, the third solenoid valve causes a retraction of the safety pin 26 and the fourth solenoid 120 will pull the breech block 27. At 0.35 seconds the fifth solenoid 134 shall drive the breech block 27 forward and position the projectile against the aforementioned spring loaded plungers. The plungers position the projectile in a launch position with the barrel. One of the plungers having a sensor 35 to activate a microswitch 140 to indicate the proper positioning of the projectile, indicator light 142, may be incorporated into one of the plungers to indicate proper position. The air cannon is now fully operational and armed to be fired.

The projectile is launched by activation of either a first trigger 150 or a second trigger 152, each of which can be used to activate various lights such as a strobe or laser. The motor 160 drives the shaft which has a series of discs having indentations to activate each step of the timing sequence; in a preferred embodiment there are six which relate to each particular step. When a trigger 150, 152 is pulled, a microswitch initiates the 24 VDC relay which energizes a coil, closes contacts, and starts a timer, by way of example a Kramer Timer. The motor rotates a series of cylinders at one revolution per approximately 1.97 seconds. On each disc there is an indentation to cause a microswitch to go down or up. As the timer turns, a particular indentation will activate a microswitch which will generally initiate at least one solenoid, but may initiate an alternative response. The angle or timing of each disc can be adjusted as desired. When the rotation is complete, a final disc 156 activates a microswitch 157 and the motor 160 stops. The trigger(s) activate the timer shaft motor via a 24 VDC relay allowing the high pressure air to enter the chamber for approximately 0.50 seconds, thus propelling the projectile out of the barrel. The second solenoid 116 is then activated to place the breech pin 26 in at 0.35 seconds, the third solenoid valve 132 causes a retraction of the safety pin 26 and the fourth solenoid 120 will pull the breech block 27. At 0.40 seconds the fifth solenoid 134 shall drive the breech block 27 forward and position the next projectile against the aforementioned spring loaded plungers and the system is made ready for the next firing sequence. The launch and loading system takes approximately 1.97 seconds.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and drawings/figures.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. The combination of a ship with a stern and an air cannon for launching projectiles by high pressure air comprising a base attached to said ship, said air cannon movably mounted on said base, said cannon having a main chamber connected to one end of a barrel, a feed chamber connected to said main chamber, said feed chamber housing at least one projectile, a movable retaining pin mounted in said feed chamber and contacting said at least one projectile, a low pressure valve fluidly coupled to said pin, a movable breech block in said main chamber, said breech block having a high pressure side and a low pressure side, at least one high pressure valve fluidly coupled to said main chamber between said high pressure side of said breech block and said one end of said barrel, a projectile in said main chamber between said one end of said barrel and said high pressure valve, at least one low pressure valve fluidly coupled to said main chamber separated from said one end of said barrel by said low pressure side of said breech block, at least one exhaust valve fluidly coupled to said main chamber separated from said one end of said barrel by said breech block, a source of high pressure air fluidly connected to said low pressure valve and said high pressure valve by a low pressure line and a high pressure line, respectively, a regulator in said low pressure line to adjust said high pressure air, a controller for operating said valves, a trigger mounted on said main chamber and connected to said controller whereby actuation of said trigger starts a launch sequence and opens said high pressure valve admitting high pressure air to said high pressure side of said breech block and launching said projectile from said barrel, said breech block moving in said main chamber away from said one end of said barrel, said launch sequence opening said low pressure valve and moving said pin out of contact with said projectile in said feed chamber, said projectile in said feed chamber moving into said main chamber between said breech block and said one end of said barrel, said low pressure on said low pressure side of said breech block moving said breech block toward said one end of said barrel to provide repeated launchings of projectiles from said ship.

2. The combination of claim 1 further comprising said controller including an electrical circuit of a plurality of solenoids activated by microswitches connected with said trigger and said valves.

3. The combination of claim 2 further comprising said controller including a timed sequence of activation.

4. The combination of claim 2 further comprising an automatic continuous timed sequence during activation of said trigger.

5. The combination of claim 2 further comprising a sensor in said main chamber connected to said controller to indicate the presence of said projectile and launching condition.

6. The combination of claim 1 further comprising an aiming device on said air cannon for determining azimuth and elevation of the barrel.

7. The combination of claim 6 further comprising a laser aiming device.

8. The combination of claim 6 further comprising a strobe aiming device.

9. The combination of claim 3 further comprising said projectiles being biodegradable whereby said projectiles do not pollute the water about said ship.

10. The combination of claim 9 further comprising said projectiles being approximately the size and shape of a golf ball.

11. The combination of claim 1, wherein said base is rotatably and pivotably connected to said main chamber, said controller opening said at least one high pressure valve for approximately 0.50 seconds upon actuation of said trigger to launch said projectile, said controller opening said at least one low pressure valve approximately 1.12 seconds later to move said breech block toward said one end of said barrel, said at least one high pressure valve and said at least one low pressure valve adapted to be connected to a source of pressurized gas.

12. The combination of claim 11 further comprising said controller including a motor and a shaft, said shaft having a plurality of discs, each disc having at least one indentation, a series of microswitches in contact with said discs whereby as said motor rotates said shaft said indentations cause said microswitches to move, said movement of said microswitches resulting in a launch sequence.

* * * * *